US007726041B2

(12) United States Patent
Woo et al.

(10) Patent No.: US 7,726,041 B2
(45) Date of Patent: Jun. 1, 2010

(54) VENTILATION SOLE FOR SHOES

(75) Inventors: Young Hwa Woo, Busan (KR); Yung Ho Kim, Busan (KR)

(73) Assignee: Kyoungdo Co., Ltd. (KR)

( * ) Notice: Subject to any disclaimer, the term of this patent is extended or adjusted under 35 U.S.C. 154(b) by 0 days.

(21) Appl. No.: 12/348,792

(22) Filed: Jan. 5, 2009

(65) Prior Publication Data

US 2009/0113768 A1 May 7, 2009

Related U.S. Application Data

(63) Continuation of application No. PCT/KR2007/001188, filed on Mar. 12, 2007.

(30) Foreign Application Priority Data

Aug. 10, 2006 (KR) ..... 20-2006-0021509 U
Feb. 7, 2007 (KR) ..... 10-2007-0012832

(51) Int. Cl.
*A43B 7/08* (2006.01)

(52) U.S. Cl. ..... 36/3 B

(58) Field of Classification Search ..... 36/3 B, 36/3 R, 3 A, 29
See application file for complete search history.

(56) References Cited

U.S. PATENT DOCUMENTS 418,966 A * 1/1890 Welander ..... 36/3 A
660,603 A * 10/1900 Troxel ..... 36/3 B
760,401 A * 5/1904 Sandmeyer ..... 36/3 R
1,223,042 A * 4/1917 Devlin ..... 36/3 A
1,392,350 A * 10/1921 O'Brien ..... 36/3 A
1,742,772 A * 1/1930 Langan et al. ..... 36/3 B
1,971,223 A * 8/1934 Kamrass ..... 36/3 A
4,771,555 A * 9/1988 Ohashi ..... 36/3 R
6,463,679 B1 * 10/2002 Buttigieg ..... 36/3 B
2006/0053655 A1 * 3/2006 Weglin ..... 36/3 B
2009/0113762 A1 * 5/2009 Leimer et al. ..... 36/114

* cited by examiner

*Primary Examiner*—Ted Kavanaugh
(74) *Attorney, Agent, or Firm*—Park & Associates IP Law LLC

(57) ABSTRACT

A ventilation sole for shoes is disclosed. The ventilation sole of the present invention has a vent hole (110), which is formed in a sidewall of the sole, an air supply hole, which is formed in the upper surface of the sole (100), and an air passage, which communicates the air supply hole with the vent hole, such that outside air is supplied into the shoe. Furthermore, the present invention is characterized in that a vent hole control device (200), which is opened or closed by a knocking operation, is installed in the vent hole (110) such that part thereof protrudes outside the sole (100), thus making it possible for a user to selectively open or close the vent hole (110), as necessary.

8 Claims, 4 Drawing Sheets

VENTILATION SOLE FOR SHOES

REFERENCE TO RELATED APPLICATIONS

This a continuation of pending International Patent Application PCT/KR2007/001188 filed on Mar. 12, 2007, which designates the United States and claims priority of Korean Patent Applications No. 20-2006-0021509 filed on Aug. 10, 2006 and No. 10-2007-0012832 filed on Feb. 7, 2007, the entire contents of which are incorporated herein by reference.

FIELD OF THE INVENTION

The present invention relates, in general, to ventilation soles for shoes and, more particularly, to a ventilation sole for a shoe which makes it possible for a user to control the opened or closed state of a vent hole, which is formed in the sole of the shoe to supply outside air into the shoe.

BACKGROUND OF THE INVENTION

In the case of typical shoes, because they are made of leather or synthetic resin, which is poorly ventilated, when a user wears the shoes for a long time, the space inside the shoes is heated and the shoes absorb moisture resulting from sweat of the user. Thereby, mold accumulates in the shoes, thus raising problems of foot odors and athlete's foot.

To solve the above-mentioned problems, ventilation soles for shoes which can ventilate the space inside the shoes were proposed.

FIG. 1 is a perspective view of a representative conventional ventilation sole for shoes.

As shown in FIG. 1, the conventional ventilation sole 100 for shoes has vent holes 110, which are formed in the sidewall of the sole 100, air supply holes 130, which are formed in the upper surface of the sole 100, and air passages (not shown), through which the air supply holes 130 communicate with the vent holes 110, so that outside air can be supplied into the shoe.

However, in the conventional ventilation sole, because the vent holes are always open, regardless of the intention of a user, when it rains, or in places where there is a lot of dust, there are problems in that rainwater permeates the shoe through the vent holes or in that dust enters and clogs the vent holes.

SUMMARY OF THE INVENTION

Accordingly, the present invention has been made keeping in mind the above problems occurring in the prior art, and an object of the present invention is to provide a ventilation sole for shoes which includes a vent hole control device provided in the sole, so that a user can easily and selectively open or close a vent hole by manipulating the vent hole control device.

In order to accomplish the above object, the present invention provides a ventilation sole for a shoe, having a vent hole formed in a sidewall of the sole of the shoe, an air supply hole formed in an upper surface of the sole of the shoe, and an air passage, through which the air supply hole communicates with the vent hole, such that outside air is supplied into the shoe, wherein a vent hole control device, which is opened or closed through a knocking operation, is installed in the vent hole such that part thereof is exposed outside the sole of the shoe.

Preferably, the vent hole control device may include a cylindrical casing unit which is open at opposite ends thereof and is tightly fitted into the vent hole, knocking means provided in the casing unit, and a movable member, advanced or retracted through an operation of pushing the knocking means to open or close an open vertex part of an outer casing of the casing unit.

ADVANTAGEOUS EFFECTS

In the present invention having the above-mentioned construction, the vent hole control device, which is opened or closed by a knocking operation, is installed in the vent hole of the ventilation sole such that part thereof is exposed outside the sole. Therefore, the vent hole can be easily and selectively opened or closed in a convenient manner.

DESCRIPTION OF THE ELEMENTS IN THE DRAWINGS

Figure 1:
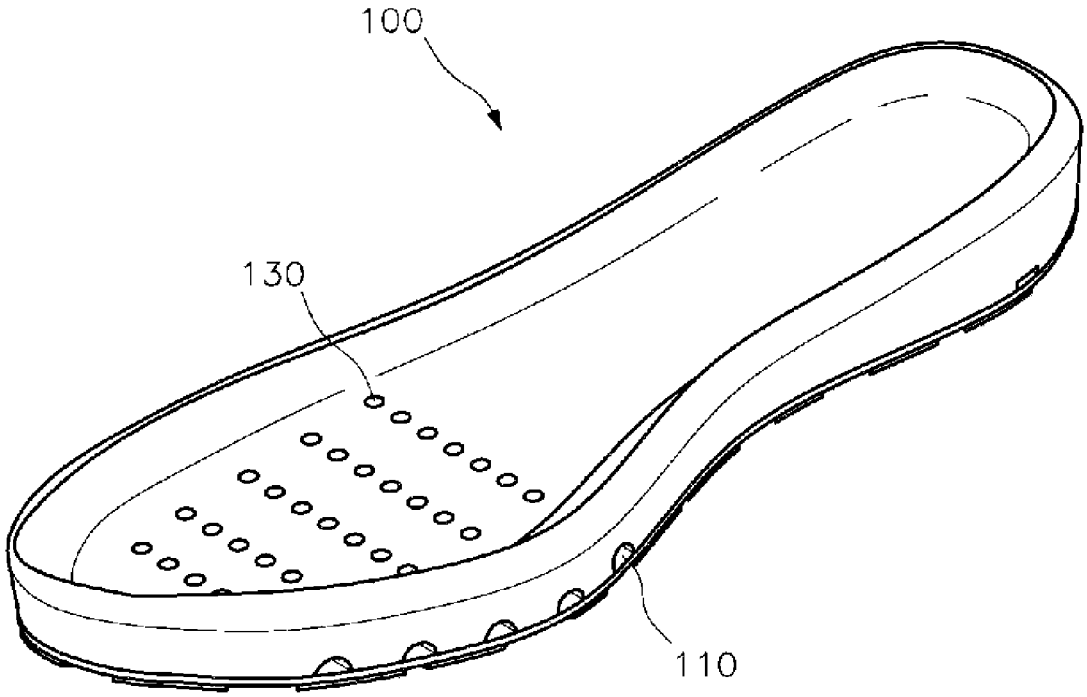
FIG. 1 (PRIOR ART)
FIG. 1 is a perspective view of a conventional ventilation sole for shoes.

100: sole 110: vent hole
200: vent hole control device 210: inner casing
211: knocking support protrusion 213: guide slot
220: outer casing 221: step
223: vertex part 230: pushing member
231: through hole 233: guide protrusion
235: uneven knocking surface 240: rotating member
241: knock protrusion 250: movable member
251: protrusion 253: through hole
255: end 260: spring
270: rubber stopper 271: inside opening surface

DETAILED DESCRIPTION OF THE INVENTION

Hereinafter, a preferred embodiment of the present invention will be described in detail with reference to the attached drawings.

Figure 2:
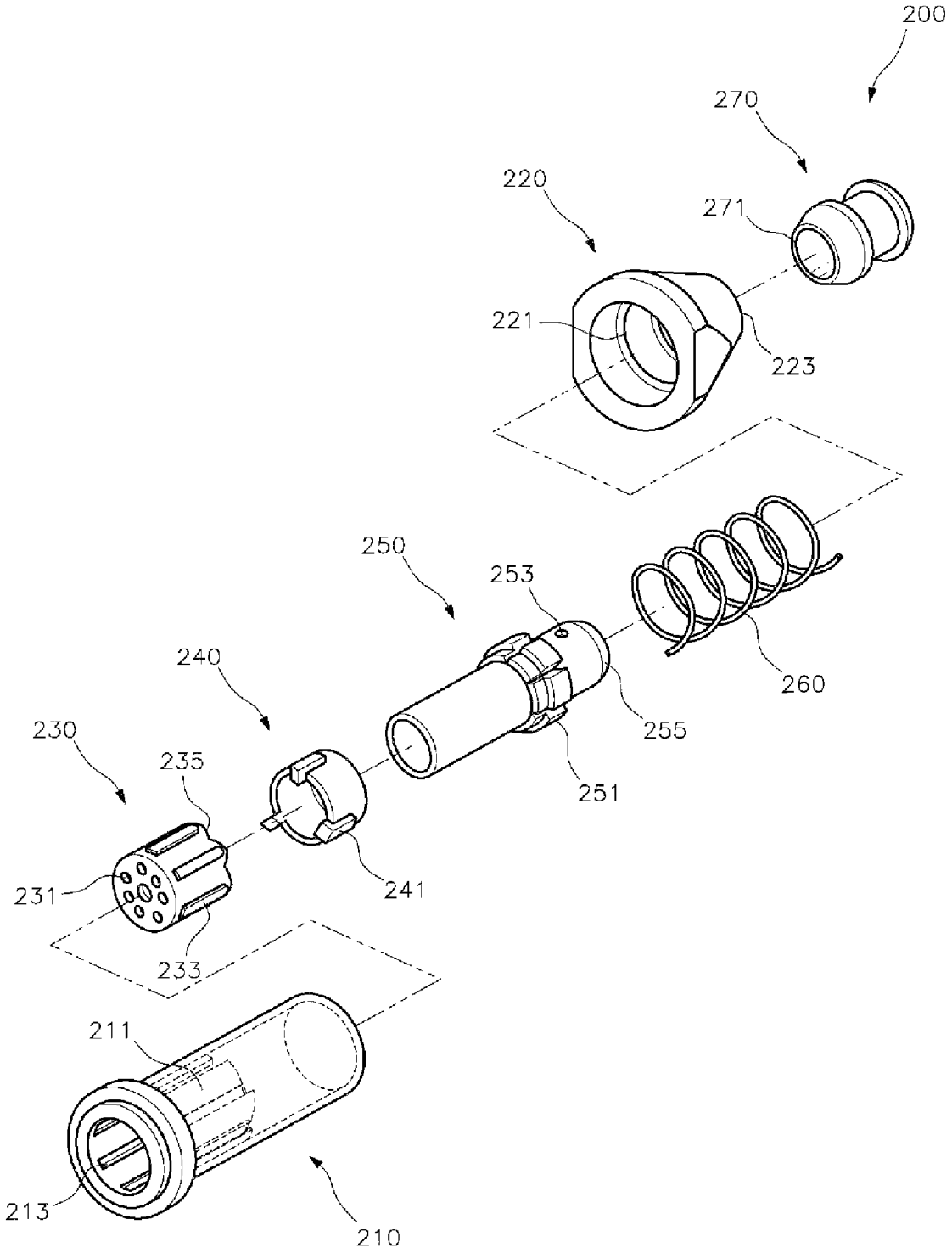
FIG. 2 is an exploded perspective view of a vent hole control device used in the present invention.

FIG. 2 is an exploded perspective view of a vent hole control device used in the present invention. The vent hole control device may be inserted into a vent hole of the conventional ventilation sole, and has a structure such that a vent hole is opened or closed by a knocking operation.

As shown in FIG. 2, the vent hole control device 200 used in the present invention includes a cylindrical casing unit 210 and 220, which is open at opposite ends thereof and fits into the vent hole, a knocking means 211, 213, 230, 240 and 260, which is provided in the cylindrical casing unit 210 and 220, and a movable member 250, which is advanced or retracted by the pushing movement of the knocking means 211, 213, 230, 240 and 260 thus opening or closing the opening formed in the cylindrical casing unit 210 and 220.

The casing unit 210 and 220 comprises an inner casing 210 and an outer casing 220. The inner casing 210 has a cylindrical shape, which is open at opposite ends thereof. Knocking support protrusions 211 and guide slots 213 are formed in the inner casing 210. The inner casing 210 is fitted into the vent hole 110 such that an end of the inner casing that is adjacent to the knocking support protrusions 211 is exposed outside.

The outer casing 220 has a conical shape, which is open at opposite ends thereof. A step 221 is formed in the inner surface of the outer casing 220. The outer casing 220 is fitted over the inner casing 210. Here, the inner casing and the outer casing are coupled to each other by bonding using a bonding agent, by fitting using frictional force, or by locking using a locking means, including a locking protrusion and a locking hole.

The movable member 250 has a cylindrical shape, which is open at one end thereof. A protrusion 251 is provided on the circumferential outer surface of the movable member 250 at a position adjacent to the open end thereof, such that the movable member 250 is advanced or retracted in conjunction with the knocking operation of the knocking means. Furthermore, a through hole 253 is formed through the circumferential outer surface of the movable member 250 at a position adjacent to the closed end, opposite the open end, so that outside air can be drawn into an open vertex part 223 of the outer casing 220 through the through hole 253.

Meanwhile, the knocking means 211, 213, 230, 240 and 260 is a toggle type advancing and retracting device, which is repeatedly advanced and retracted every time force is applied thereto. Such toggle type devices are disclosed in Korean Utility Model Registration No. 20-0214559, Korean Patent Registration No. 10-0324011 and Korean Utility Model Registration No. 20-00385457. Therefore, the structure and operation of the knocking means used in the present invention will be explained in brief herein below.

The knocking means 211, 213, 230, 240 and 260 used in the present invention includes the knocking support protrusions 211, the guide slots 213, a pushing member 230, a rotating member 240 and a spring 260. The knocking support protrusions 211 and the guide slots 213 are formed in the inner casing 210, as described above.

The pushing member 230 and the rotating member 240 are sequentially received in the inner casing 210. The pushing member 230 has a cylindrical shape, which is open at a first end thereof. An uneven knocking surface 235 having a zigzag shape is formed on the edge of the open first end of the pushing member 230. A plurality of through holes 231 is formed through a second end of the pushing member 230, which is exposed outside. Furthermore, a plurality of guide protrusions 233, which slide along the respective guide slots 213, is formed on the circumferential outer surface of the pushing member 230.

The rotating member 240 has a cylindrical shape, which is open at opposite ends thereof. A plurality of knock protrusions 241, which contact the uneven knocking surface 235 and are alternately locked to the knocking support protrusions 211 or inserted into the guide slots 213 every time the pushing member 230 is pushed, is formed on the circumferential outer surface of the rotating member 240.

The spring 260 is disposed between the protrusion 251 of the movable member 250 and the step 221 of the outer casing 220 to provide elastic force required for the knocking operation.

Therefore, in the vent hole control device 200 according to the present invention, the vertex part 223 of the outer casing 220 is opened or closed by the movable member 250, which is advanced or retracted by the knocking means 230, 240 and 260, so that, when the vertex part 223 is opened, air, passing through the through holes 231 of the pushing member 230 and through the through hole 253 of the movable member 250, is drawn into or discharged from the shoe through air supply holes 130 in the upper surface of the ventilation sole 100 via the vertex part 223 of the outer casing 220. In other words, when necessary, the user can push the pushing member 230 of the knocking means, and thus open or close the vent hole 110.

In the drawings, the reference numeral 270 denotes a rubber stopper, which is provided in the vertex part 223 of the outer casing 220. Preferably, the rubber stopper is provided to further enhance the reliability of the opened or closed state, created by movement of the movable member 250.

Figure 3:
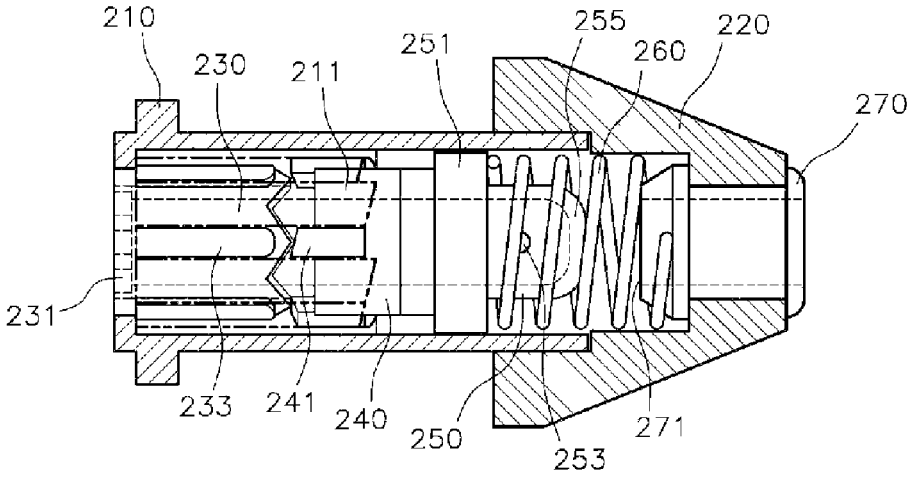
FIGS. 3 and 4 are views showing the operation of the vent hole control device according to the present invention.
Figure 4:
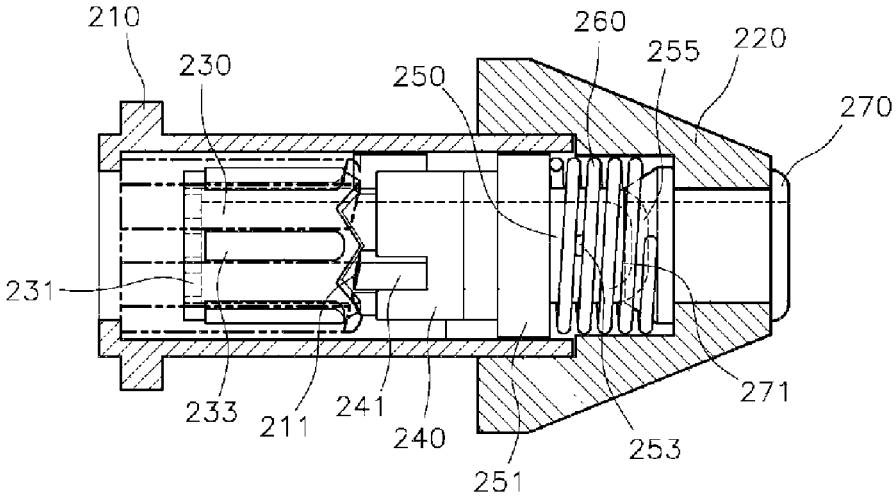

FIGS. 3 and 4 are views illustrating the operation of the vent hole control device according to the present invention. FIG. 3 illustrates the opened state of an inside opening surface 271 of the rubber stopper 270. FIG. 4 illustrates the closed state of the inside opening surface 271 of the rubber stopper 270.

First, FIG. 3 shows the end 255 of the movable member 250, spaced apart from the rubber stopper 270. In this state, air, drawn through the through holes 231 of the pushing member 230, passes through the through hole 253 of the movable member 250 and is supplied into the space inside the shoe through the rubber stopper 270.

FIG. 4 shows the state in which the end 255 of the movable member 250 is brought into contact with the inside opening surface 271 of the rubber stopper 270 by pushing the pushing member 230 from the state of FIG. 3. In this state, air, drawn through the through holes 231 of the pushing member 230, can be moved to the outer casing 220 through the through hole 253 of the movable member 250, but cannot be supplied into the space inside the shoe, because the inside opening surface 271 of the rubber stopper 270 is closed by the end 255 of the movable member 250.

As such, the user can select the opened or closed state of the vent hole 110 using the vent hole control device 200.

Figure 5:
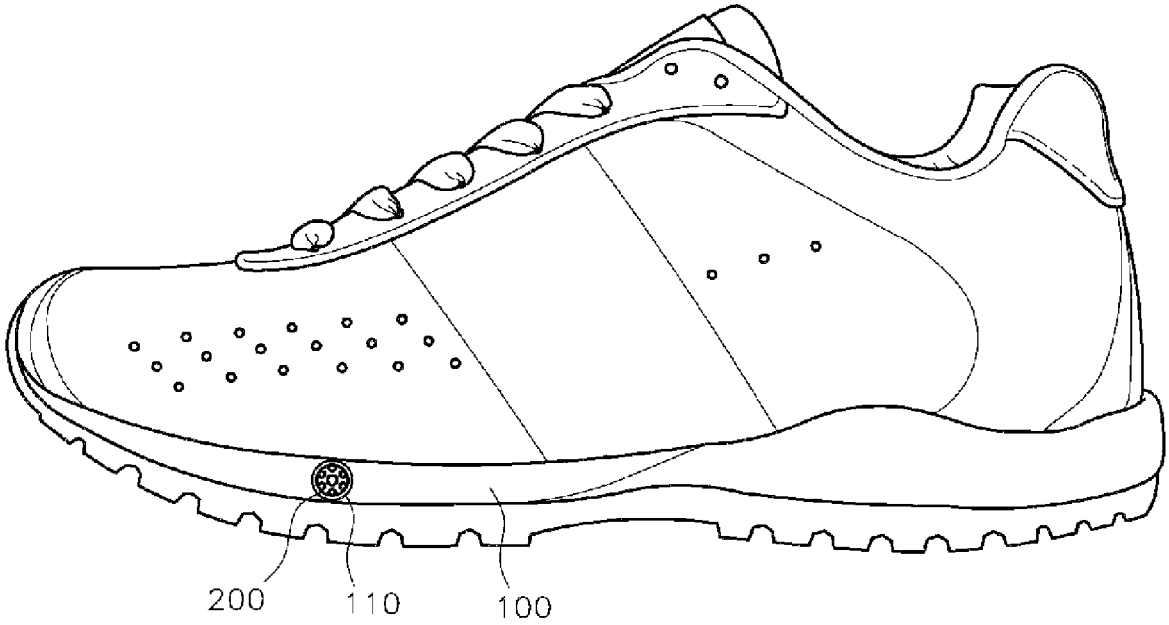
FIG. 5 is a side view of a shoe having a ventilation sole according to the present invention.

FIG. 5 is a side view of the shoe having the ventilation sole according to the present invention, showing the vent hole control device 200 inserted into the vent hole 110 of the sole 100 of the shoe.

Those skilled in the art will appreciate that the ventilation sole for shoes according to the present invention is not limited to the embodiment described above, and that various modifications are possible, without departing from the scope and spirit of the invention.

INDUSTRIAL APPLICABILITY

As described above, the present invention provides a ventilation sole for a shoe which allows a user to selectively and conveniently open or close a vent hole, thus preventing foreign substances such as water or dust from entering the shoe, thereby preventing the vent hole from clogging.

What is claimed is:

1. A ventilating sole for a shoe, including a vent hole formed in a sidewall of the sole of the shoe, at least one air supply hole formed in an upper surface of the sole of the shoe, and an air passage, through which the air supply hole communicates with the vent hole, such that an outside air is supplied into the shoe, wherein a vent hole control device, which is configured to open or close the air passage through a knocking operation, is installed in the vent hole while having a part thereof exposed outside the sole of the shoe, wherein the vent hole control device comprises a casing unit which includes an opening through opposite ends thereof and is fitted into the vent hole, and knocking means provided in the casing unit, the knocking means coupled with a movable member to selectively advance and retract the movable member through an operation of pushing the knocking means to open or close the air passage for selective ventilation of the shoe by user selection.

2. The ventilating sole for the shoe according to claim 1, wherein the casing unit comprises an inner casing and an outer casing, and wherein the knocking means for conducting the knocking operation, comprises: a plurality of knocking support protrusions and a plurality of guide slots provided in the inner casing of the casing unit; a pushing member having a cylindrical shape, which is open at a first end thereof, with an uneven knocking surface, having a zigzag shape, formed on a circumferential edge of the first end of the pushing member, a plurality of through holes formed through a second end of the pushing member, which is exposed outside, and a plurality of guide protrusions provided on a circumferential outer surface of the pushing member, the guide protrusions sliding along the respective guide slots; a rotating member having a cylindrical shape which is open at opposite ends thereof, with a plurality of knock protrusions provided on a circumferential outer surface of the rotating member, the knock protrusions contacting the uneven knocking surface and being alternately locked to the knocking support protrusions or inserted into the guide slots every time the pushing member is pushed; and a spring disposed between the movable member and the outer casing to provide elastic force required to conduct the knocking operation.

3. The ventilating sole for the shoe according to claim 1, wherein the movable member has a cylindrical shape, which is open at a first end thereof, with a protrusion provided on a circumferential outer surface of the movable member at a position adjacent to the open first end of the movable member, such that the movable member is advanced or retracted in conjunction with the operation of knocking the knocking means, and a through hole formed through the circumferential outer surface of the movable member at a position adjacent to a closed second end of the movable member, such that outside air is drawn through the through hole and into an open vertex part of the outer casing.

4. The ventilating sole for the shoe according to claim 2, further comprising: a cylindrical rubber stopper provided in the vertex part of the outer casing, the cylindrical rubber stopper having an inner opening through opposite ends thereof and being detachably brought into contact with the closed second end of the movable member, so that the inner opening of the cylindrical rubber stopper is opened or closed by movement of the movable member.

5. The ventilating sole for the shoe according to claim 3, further comprising: a cylindrical rubber stopper provided in the vertex part of the outer casing, the cylindrical rubber stopper having an inner opening through opposite ends thereof and being removably brought into contact with the closed second end of the movable member, so that the inner opening of the cylindrical rubber stopper is opened or closed by movement of the movable member.

6. A ventilating shoe comprising:

a sole having an upper surface, a lower surface, and a sidewall surface, the sole including a vent hole formed in the sidewall surface of the sole, at least one air supply hole formed in the upper surface of the sole, and an air passage, through which the air supply hole communicates with the vent hole for providing an outside air into the shoe; and a vent hole control device installed in the vent hole, the vent hole control device including a casing unit with an inner opening formed there-through, and knocking members received in the inner opening of the casing unit, the knocking members including a pushing member with a distal part thereof accessible for pushing by a user through the inner opening of the casing unit for a knocking operation thereof, the knocking members coupled with a movable member to selectively advance and retract the movable member through the knocking operation of pushing the pushing member to open or close the air passage with the movable member for selective ventilation of the shoe by the user selection.

7. The ventilating shoe according to claim 6, wherein the casing unit includes an inner casing and an outer casing coupled with each other and defining the inner opening therethrough, and wherein the knocking members further includes a rotating member operably coupled to the pushing member, and a coil spring to provide an elastic force to the movable member.

8. The ventilating shoe according to claim 7, further comprising a rubber stopper, the rubber stopper coupled to a stepped portion of the inner opening of the outer casing to provide an airtight seal to the air passage when the movable member is in closed position.

* * * * *